US005096175A

United States Patent [19]

Lange et al.

[11] Patent Number: 5,096,175

[45] Date of Patent: Mar. 17, 1992

[54] FOLDING JAW ADJUSTMENT SYSTEM FOR A PRINTING MACHINE FOLDING CYLINDER

[75] Inventors: Klaus-Ulrich Lange, Gersthofen; Eckhard Schneider, Stadtbergen; Friedrich Michaelis, Augsburg, all of Fed. Rep. of Germany

[73] Assignee: MAN Roland Druckmaschinen AG, Offenbach am Main, Fed. Rep. of Germany

[21] Appl. No.: 680,807

[22] Filed: Mar. 20, 1991

[30] Foreign Application Priority Data

Apr. 26, 1990 [DE] Fed. Rep. of Germany ..... 4013419
Nov. 22, 1990 [DE] Fed. Rep. of Germany ..... 4037130

[51] Int. Cl.[5] ..... B42C 1/00

[52] U.S. Cl. ..... 270/49; 270/47; 270/50; 493/425; 493/429; 493/426

[58] Field of Search ..... 270/45, 47–51, 270/21.1, 60, 18, 12; 493/424–426, 432, 434, 435, 430, 426–429, 471, 476

[56] References Cited

FOREIGN PATENT DOCUMENTS 2103946 8/1972 Fed. Rep. of Germany .
2537920 3/1977 Fed. Rep. of Germany .
2714915 10/1978 Fed. Rep. of Germany ..... 270/47
7815194 3/1979 Fed. Rep. of Germany .
2936768 4/1981 Fed. Rep. of Germany ..... 270/50
3040701 9/1981 Fed. Rep. of Germany .
3838314 5/1990 Fed. Rep. of Germany .

*Primary Examiner*—Edward K. Look
*Assistant Examiner*—Therese M. Newholm
*Attorney, Agent, or Firm*—Frishauf, Holtz, Goodman & Woodward

[57] ABSTRACT

To move folding jaws (4, 5) in a scissor-like or pincer-like movement symmetrical with respect to a center line (CL) and to permit adjustment of the gap or opening of the jaws, for acceptance of folded substrates of different thicknesses, the jaws are coupled together by a rotation reversal arrangement (14, 114, 112, 314) so that rotation of one of the carrier bodies (6) will be transferred as an equal and opposite movement to the other (7) of the carrier bodies. An axial position adjustment spindle (25, 125, 325), controllable by a hand wheel (29) or servo motor (30), changes the axial position of gears rotating or rotating with a shaft (2, 202, 402) of a folding jaw cylinder (1, 201, 401), at least some of the gears or gear pairs having inclined teeth, to thereby transfer a positioning movement into a relative rotary shift of the respectively rotating gear with respect to the gear driving the shaft, thereby causing rocking or tilting of the folding jaw carriers (6, 7).

18 Claims, 5 Drawing Sheets

FOLDING JAW ADJUSTMENT SYSTEM FOR A PRINTING MACHINE FOLDING CYLINDER

FIELD OF THE INVENTION

The present invention relates to a folding apparatus to fold sheets or portions of a web of a substrate, for example paper derived from a printing machine, and more particularly to an adjustment arrangement to control the relative position of folding jaws, forming a folding jaw pair with respect to a reference line, to permit folding of a plurality of sheets or web layers, in which the number of sheets or web layers varies, so that the folding jaws will be symmetrically positioned, with varying distances, in dependence on the thickness of the substrate assembly or bundle to be folded. The position of the folding jaws should always be symmetrical with respect to such a reference or center line, which is also the operating direction or defines an operating plane of a folding blade, to be projected against the sheet or sheet assembly or bundle, and to push the sheet, sheet assembly or bundle into the folding jaws, for subsequent gripping thereby.

BACKGROUND

It has previously been proposed to simultaneously adjust a pair of folding jaws to move towards or away from each other, for subsequent pincer or gripper-like operation. The folding jaws, normally, are each retained on a respective folding jaw support or carrier body which can swivel or rock about the shaft axis of the folding jaw cylinder. Each folding jaw carrier, of a pair, carries out a movement which is opposite to that of the associated folding jaw carrier, to either spread or narrow the gap between the folding jaws prior to the pinching or gripping operation, so that a folding blade or knife can penetrate between the folding jaws at a predetermined plane, typically a center line between the folding jaws. German Patent 25 37 920 describes a folding jaw cylinder which has one counterfolding jaw strip located at the circumference and a cooperating folding jaw, which can be selectively positioned by oppositely directed adjustment of the folding strip and the folding jaw. The folding jaw is eccentrically rotatably positioned in a carrier which holds the counter folding strip, for eccentric rotation with respect to the counter holding strip. Rotation is controlled by a positioning arrangement. The folding jaw is rotationally elastically coupled to the carrier of the folding cylinder by a torsion spring. The carrier, in turn, is connected by a joint or link with a lever engaging in an opening or recess of the carrier. A coaxial recess in the axis of the cylinder retains a slider element having an inclined plane or surface thereof, slidable in the coaxial recess, for radial adjustment of the lever. The slider element can be positioned by an externally accessible positioning element, for example a hand wheel which is coupled to a spindle. The slider element is supported by an axial bearing, so that the positioning element can be fixed but, upon rotation, can move the spindle and hence the inclined plane of the slider element and thus the engagement point of the lever.

Readjustment of the folding jaws in this system is possible during rotation of the cylinder. The positionable folding jaw and the counter folding strip are moved, in a pincerlike movement, towards or away from each other.

It has been found that the adjustment path of this system, which requires a multiplicity of levers and an inclined plane, is a complex structure, which has to be provided for each one of the folding jaws which may be located on the circumference of a cylinder. Further, the lever which runs with one of its ends on an inclined plane causes problems. The angle of inclination of the inclined plane is less than the inclination corresponding to the coefficient of friction in order to obtain self-locking or self-adjustment of the lever without a separate locking arrangement. This causes a substantial friction to occur between the lever and the inclined plane. If a plurality of folding jaws are located on the folding jaw cylinder, each one of the folding jaws must be carefully adjusted so that they all operate with the same axial positioning—folding jaw opening transfer characteristic. This requires careful and costly readjustment after use, since the inclined planes of the sliders are subject to substantial wear. Transfer of the adjustment forces, of course, should be without play. Due to the high wear to which the engagement surfaces of slider and lever are subjected, uneven opening and/or closing gaps may well result. The wear on the arrangement is enhanced due to loading, frequently, at similar positions. Control of the opening gap of the folding jaws can be effected only from one side of the cylinder.

THE INVENTION

It is an object to improve a folding jaw cylinder in which the assembly and adjustment of the folding jaws, with counter-directed opening or closing gap movements, is simplified, which is subjected only to low wear, and in which the number of folding jaw pairs, and/or their support or carrier bodies, is independent of the overall adjustment system, while ensuring, simultaneously, pincer-like adjustment movement of the respective folding jaws with respect to a reference or pinching or center line, so that subsequent readjustment of the operation of the folding blade or knife of a folding blade cylinder is not necessary.

Briefly, a gearing arrangement is provided coupled to a position control element, such as a spindle which can be operated by a servo motor or a hand wheel, which gearing arrangement includes a first gear train coupled to a first one of the pinching jaw carrier bodies for rocking or swiveling the carrier body in a first direction; a second gearing means coupled to a second one of the jaw carrier bodies for rocking or swiveling the second one of the jaw carrier bodies about the shaft of the cylinder in a direction opposite to the first direction, so that, upon operation of the gearing means, the folding jaws will be moved towards or away from each other. A rotation reversal arrangement interconnects of forms part of the first and the second gearing means. The rotation reversal arrangement may include a further gear train, or angles of inclination of the teeth the gears. Upon rotation of the gears, in the respectively opposite directions, the jaw bodies, and hence the folding jaws, will pivot or swivel or rock in respectively opposite directions, thereby setting the clearance or gap distance between the jaw faces of the folding jaws. The folding jaws, themselves, are operated to clamp the folded printed products, as well known, for example by a camming arrangement or the like.

DRAWINGS

DETAILED DESCRIPTION

Figure 1:
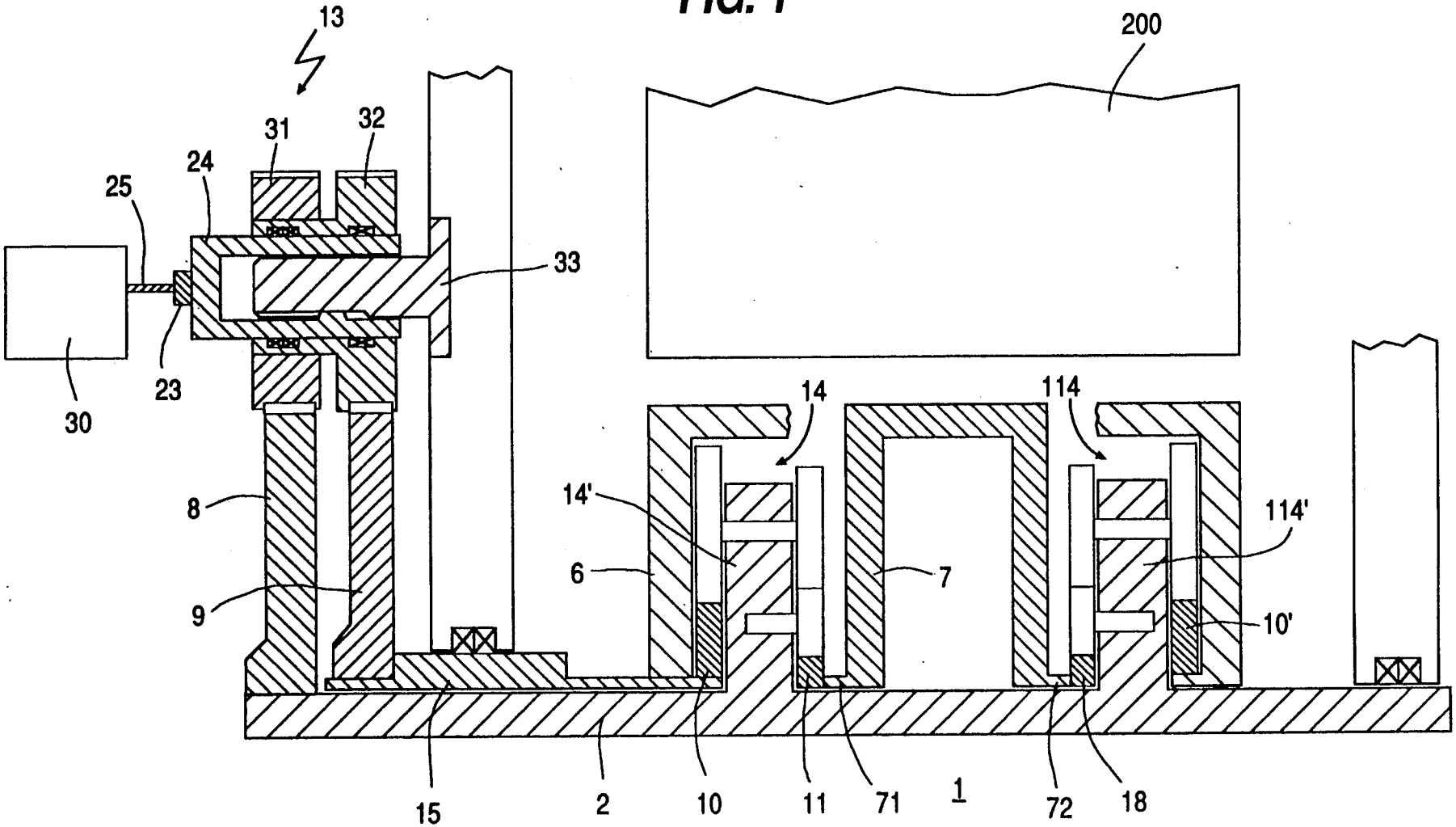
FIG. 1 is a schematic axial sectional view of a first embodiment of a folding jaw positioning system.
Figure 3:
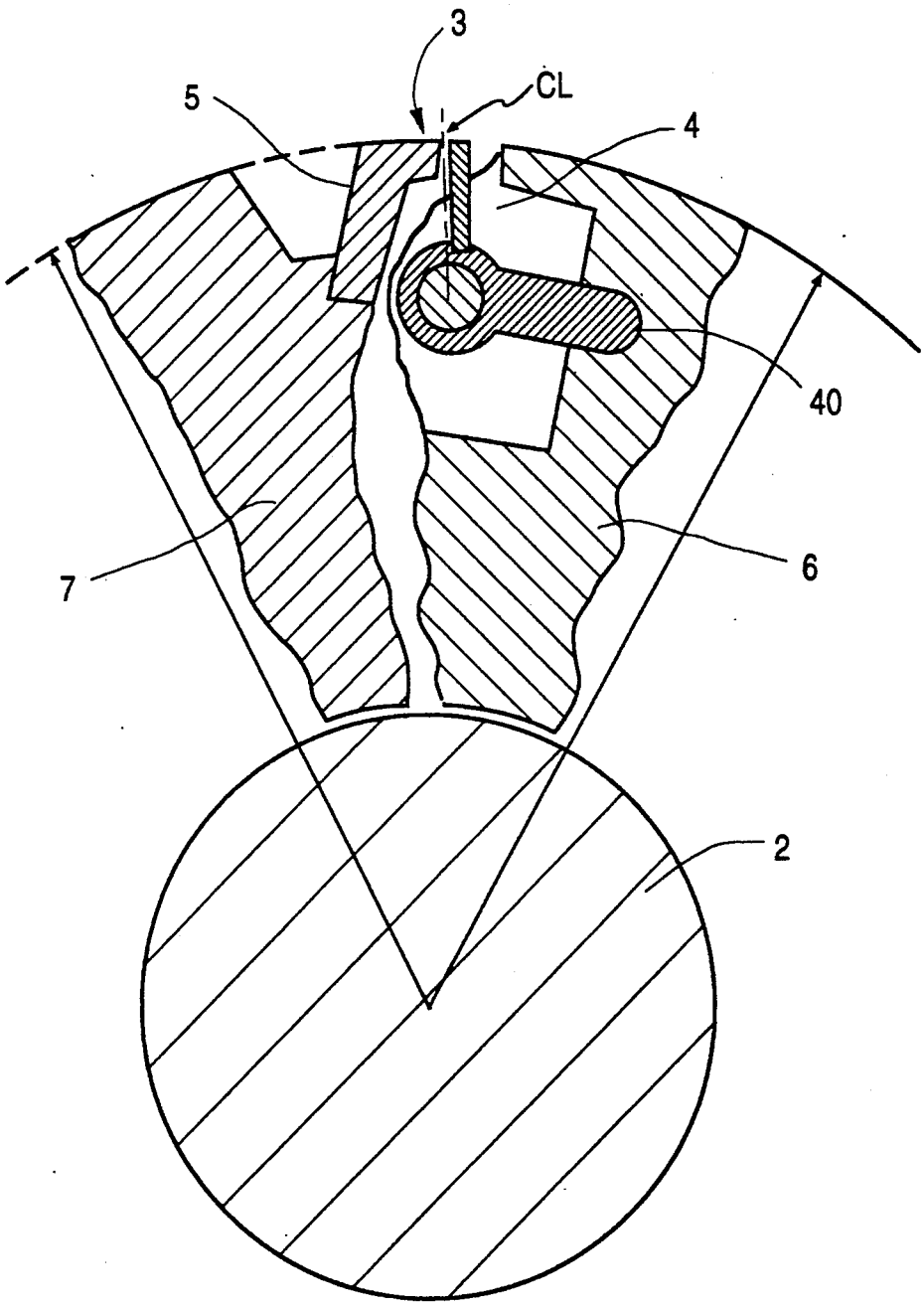
FIG. 3 is a fragmentary radial sectional view omitting all elements not necessary for an understanding of the present invention and illustrating a folding jaw pair of a folding jaw cylinder.

Referring first to FIG. 1, which is a highly schematic representation of the system to position folding jaws of a folding jaw cylinder in accordance with a first embodiment of the invention. The folding jaw cylinder 1 has a cylinder shaft 2. Coaxially located on the shaft 2, and positioned within each other, are essentially cylindrical folding jaw carrier bodies 6, 7, which carry the folding jaw pairs 3 (FIG. 3). The folding jaw carrier bodies 6, 7 are pivotably or swivellingly movable about the shaft 2. The carrier body 6 has a plurality of controllable movable folding jaws 4 secured thereto, as illustrated in FIG. 3; the carrier body 7 has a plurality of fixed or counter jaws 5 located thereon. One, each, movable jaw 4 and a fixed jaw 5 form a jaw pair. Control of the movable jaw during folding of a substrate product, for example a sheet or a bundle or stack or group of sheets as the folding jaw cylinder rotates, is carried out as well known, and not specifically shown in the drawings, for simplicity; a control cam follower, running off a rotary cam curve - neither of which is shown—is suitable.

FIG. 3 illustrates the arrangement of the folding jaw pair 3 in a folding jaw cylinder 1, for a single folding jaw pair. The control for the movable folding jaw 4 is shown only symbolically by a projecting lever 40.

Referring again to FIG. 1:

The folding jaw cylinder 1 is driven by a first gear 8 secured to the shaft 2 of the folding cylinder 1. The gear 8 is coupled to a second gear 9 on a gear block 13. The second gear 9 is rotatably located on the shaft 2. The gear 9 and the folding jaw carrier body 6 are coupled together by a first flange bushing 15 surrounding the folding jaw cylinder shaft 2 coaxially. The bushing 15 is rotatable with respect to the shaft 2. By this arrangement, the controllable folding jaw 4 is driven synchronously with respect to the gear 8. The flange bushing 15 is formed with a projecting flange at the end remote from that close to the gear 8; the end flange is securely connected to a third gear 10, coaxial with respect to the cylinder shaft 2. The third gear 10 is in engagement with a rotation reversal gearing 14.

The rotation reversal gearing 14 has a support structure 14', secured to the cylinder shaft 2. The support structure 14' carries a plurality of gears, in which for simplicity of description, only those which are necessary to be explained in detail to ensure understanding of the overall operation are shown. The rotation reversal drive 14, upon shifting of position of the folding jaws, transfers relative rocking or swiveling or rotary movement of the folding jaw carrier body 6 with respect to the folding jaw cylinder shaft 2 with a 1 : 1 transmission ratio to the folding jaw carrier body 7 while reversing the direction of rotation.

The folding jaw carrier body 7 has two facing sides, each of which are formed with a flange 71, 72, respectively. Flange 71, continuously or in sector portions, is formed with an external gearing 11. Gearing 11 is in engagement with the gears of the rotation reversal arrangement 14. The flange 72 has an external gearing 18. To ensure parallel change of position of the folding jaws 4 and 5, flange 72 may be coupled to a further rotation reversal drive 114, which can be identical to reversal drive 14, but mirror-symmetrical with respect thereto. The rotation reversal drive 114 has a fixed support structure 114', secured to the shaft 2 of the cylinder. The rotation reversal drive 114 is in engagement with the external gearing 18 and a gear 10' secured to the folding jaw carrier 6. Thus, the folding jaw carrier 6 has rotary force applied at both its end regions and the carrier 7 is uniformly stressed at both its facing sides as well. The gear block 13 (FIG. 1), essentially, is formed by a carrier element 24, which is an essentially hollow cylindrical structure having an internal thread 23 to receive a positioning spindle 25. The carrier body or sleeve 24 is axially movable, but not rotatable and constrained against rotation by an internal projection engaging in the spline of the support stub or bolt or pin 33. At least the two gears 31 and 32 are rotatably and coaxially located on the circumference of the carrier sleeve 24. A rotation transmitting element, such as a servo motor 30, or a hand wheel 29 (FIG. 2), is coupled to the spindle 25 for rotation thereof.

Operation

The carrier sleeve 24 is coupled via the thread 23 with the spindle 25. The spindle is rotatable, for example under control of a remote controlled servo motor 30. Preferably, the servo motor 30 includes a feedback potentiometer, so that the actual position of the spindle 25 can be accurately controlled.

Drive of the spindle 25 causes axial shifting of the gear block 13. Due to the combination of the gearing of the gears 31 and 32 and the gears 8, 9, the gear 9 will be rotated relative to the gear 8. The rotation reversal drive 14 provides for reversal of direction of rotation of the folding jaw carrier body 7 counter that of the shifting of the carrier body 6. The second reversal drive 114 changes this reversed rotation back to the rotation shift of the gear 6, so that the end portions of the carrier body 6 are moved in unison, ensuring parallel shifting of the carrier body 6 and hence of the associated folding jaw. Together, the shifting movements provide for simultaneous, pincer-like or scissor-like adjustment position movement of one each of the control folding jaw 4 and the associated fixed folding jaw 5, so that adjustment of the position of a folding blade secured, for example, to a folding blade cylinder 200 (FIG. 1) is not necessary and the center line or closed position of the folding jaws will be in varying, regardless of the spacing of the jaws when they are open. The center line is shown schematically in FIG. 3 at CL.

The gearing of the second gear 9 and the pinion gear 32 is an inclined or spiral gearing. The pinion gear 32 is rotatably retained on sleeve 24 by suitable bearings and the pinion gear 31 is locked to gear 32, for example by a projecting sleeve extending from pinion 32. The gearing on gear 8 as well as the gearing on gear 31 can be straight, axially, so that the gearing actually is a spur gear arrangement; alternatively, both the gearing connecting gears 8 and pinion 31 as well as connecting the gear 9 and pinion 32, can be inclined or spiral gears, in which the angles of inclination of the respective gearing 8–31 and 9–32 are divergent or opposite each other.

Figure 2:
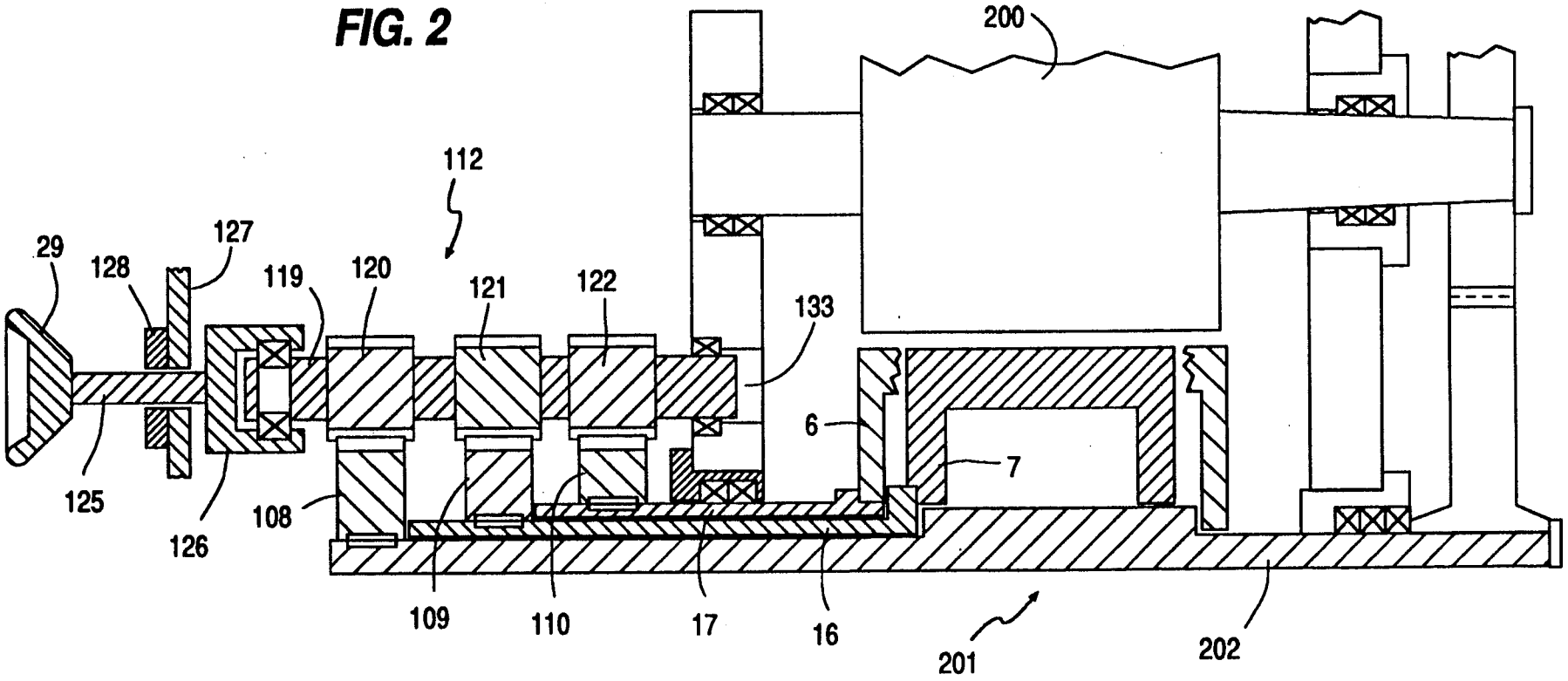
FIG. 2 is a schematic axial view of a second embodiment of the folding jaw positioning system.

The spindle 25, which pulls the sleeve 24 of block 13 in and out, to effect relative repositioning of the circumferential position of gear 9 with respect to gear 8 can, desirably, be coupled to a hand wheel 29 (FIG. 2).

Embodiment of FIG. 2:

The folding jaw cylinder 201 has a shaft 202 and folding jaw carrier bodies 6, 7 (see FIG. 3). They are identical to those described in connection with FIG. 1 and can form cylindrical elements, which can rock or swivel or pivot about the folding jaw cylinder shaft 2. The folding jaw carrier body 6 has a plurality of controllable jaws 4 thereon; the carrier body 7 has a plurality of fixed jaw elements 5 thereon, in which the jaws 4, 5 together form a jaw pair 3, as previously described and as best seen in FIG. 3.

A fourth gear 108 is securely connected to the shaft 202. A fifth gear 109 and a sixth gear 110, each, are coaxially located on the shaft 202, but rotatable with respect thereto. The fifth gear 109 is connected to the folding jaw carrier body 7 by a second flanged sleeve 16, which surrounds the shaft 2 and is rotatable with respect thereto. The sixth gear 110 is coupled to the folding jaw carrier body 6 by a third flanged sleeve 17 which surrounds the second flanged sleeve 16 and is rotatable with respect thereto.

The fourth gear 108 has an axially directed spur gearing. The fifth gear 109 and the sixth gear 110 are inclined or spirally geared, with oppositely directed angles of inclination. The gears 108, 109 are coupled to a gearing 112. Gearing 112 includes a pinion shaft 119, a first pinion 120, a second pinion 121 and a third pinion 122. The first pinion 120 in engagement with gear 108 is axially geared; the second pinion 121 and the third pinion 122 are spirally geared, with relatively oppositely directed angles of inclination, such that the angle of inclination of the second pinion 121 and of the third pinion 122, each, correspond to the respective spiral angles of inclination of the gears 109 and 110 respectively. The gears 108, 109, 110, together with the pinions 120, 121, 122 so operate and are so connected together that rotation of the gear 109 with respect to the gear 108 is transferred in an equal and opposite rotation of the gear 110.

An axial shifting arrangement is formed by a spindle 125 received in a spindle nut 128 secured to a carrier plate 127, to which the pinions 120, 121, 122 are connected. The entire gearing 112 is secured in a jaw or sleeve-like holder 126, coupled to the spindle 125. The other end of the shaft 119 is retained in a counter bearing 133, which permits axial sliding. Bearing 133 is located in a side wall of the machine supporting the folding blade cylinder and the folding jaw cylinder. A hand wheel 129 is coupled to the spindle 125 so that the spindle 125, upon rotation, will move from right to left and reverse, in accordance with the respective direction of rotation of the hand wheel 29.

Operation, embodiment of FIG. 2

Upon turning hand wheel 29, spindle 125 and the holder sleeve 126 are rotated and axially moved. This shifts the gearing 112 in axial direction. The shifting of the gearing 112 is due to the combination of the differently directed gearings of the pinions 120–122 and gears 108–110, causing relative rotation of the gear 109 with respect to gear 108 in one direction and relative rotation of the gear 110 with respect to the gear 108 in the opposite direction. These adjustment movements, taken together, provide for simultaneous scissor or pincer-like adjustment position of the respective folding jaws 4 and 5, so that readjustment of the position of a folding blade in the folding blade cylinder 200 is not necessary.

Rather than using a hand wheel 29, a servo motor drive like servo motor drive 30 (FIG. 1) may also be used.

Figure 4:
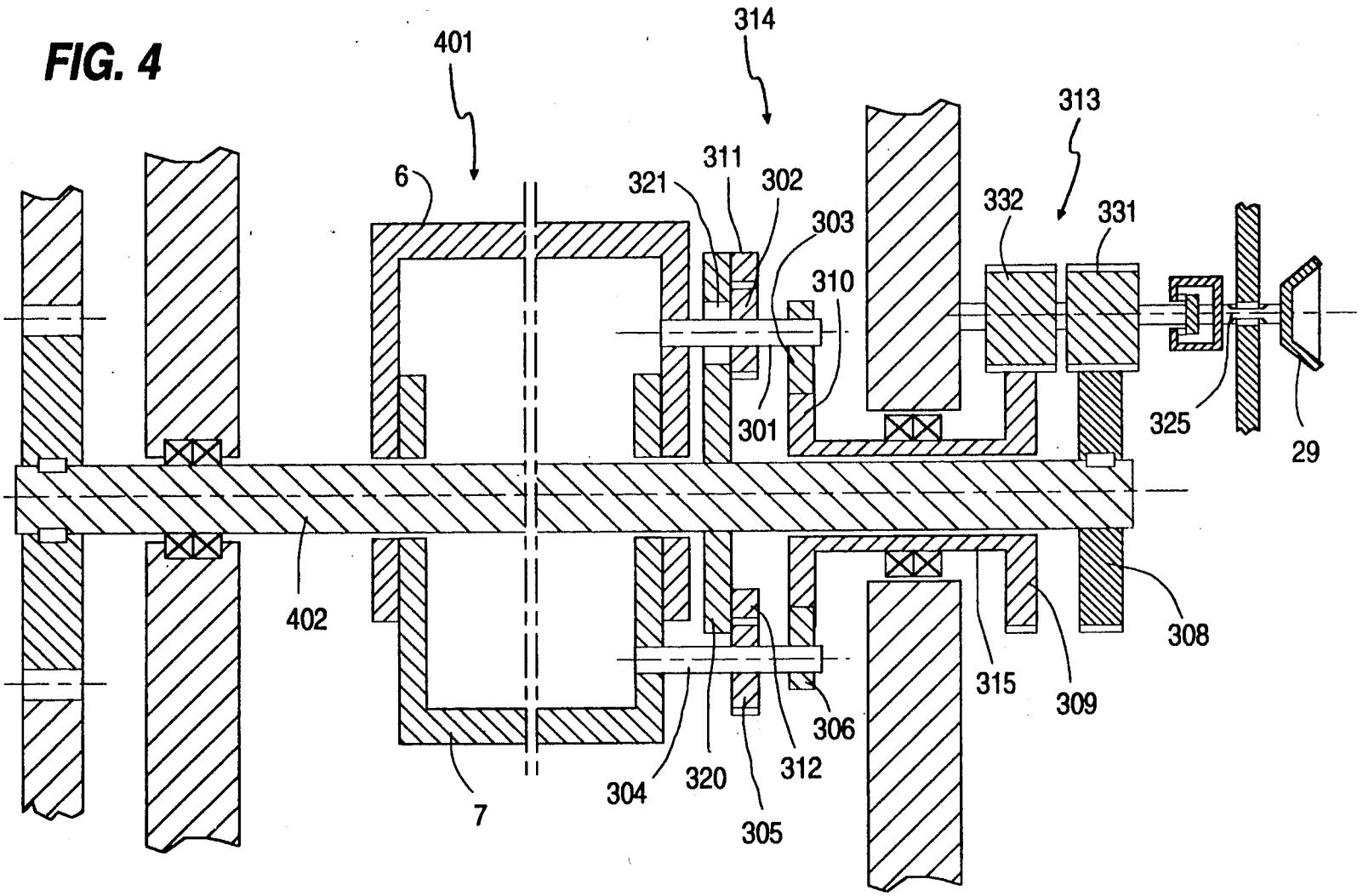
FIG. 4 is a schematic axial sectional view of a third embodiment of the structure of the present invention.

Embodiment of FIG. 4:

A folding jaw cylinder 401 has a cylinder shaft 402 on which, as seen in FIG. 3, the folding jaw carrier bodies 6 and 7 are located, carrying the respective folding jaws 4 and 5 as previously described. A seventh gear 308 is securely connected to the shaft 402 to drive the cylinder 401. The gear 308 is coupled to a gear block 313 which has at least two externally geared gears 331, 332 thereon. Gear 332 is in meshing engagement with an eighth gear 309, coaxially located on the shaft 2 but rotatable therewith. The eighth gear 309 and the carrier body 6 are coupled via a gear train which is formed by a fourth flanged sleeve 315 coaxially and rotatable with respect to the shaft 402. It is formed, at the end remote from the gear 308, with a ninth gear 310 which is coupled to a gear element 303. Gear element 303 is retained on a first shaft 301 which is rotatably received in the carrier body 6. It extends parallel to the axis of rotation of the shaft 2. The gear 303 is secured on the shaft 301, to rotate therewith.

The first gear element 303 and the tenth gear 302, which rotates with and is attached to shaft 301, together with a second shaft 304 which is rotatably located in the carrier element 7, an eleventh gear 305 and a second gear element 306, both of which are secured on the shaft 304, form a part of a rotation reversal drive 314. The shaft 304, eleventh gear 305 and second gear element 306 correspond, and are similar to gear 302 and gear element 303 on shaft 301. The direction reversal drive 314 is in engagement with the gear 310 on the flanged sleeve 315. The rotation reversal arrangement further includes a support element 320 secured on the shaft 402 and rotating therewith. The support element 320 carries a substantially circular segmental gear element 311 having an internal gear located thereon, and an essentially circular segmental fourth gear element 312 having an external gearing applied thereto. The gear elements 311 are located in meshing engagement with the gear 302. The gear element 312 is in meshing engagement with the gear 305. The support element 320 is formed with an elongated opening 321 through which the shaft 301 can freely pass.

Operation, embodiment of FIG. 4:

The rotation reversal gearing or drive 314 transfers relative rotation of the gear 309 with respect to the gear 308, by rolling off of gear 302 on the gear element 311 causing a shift in position of the folding jaw carrier body 6, since the shaft 301 is moved in circumferential direction of the body 6. The body 7 is shifted in position by rolling off the gear 305 on the gear element 312, so that the spindle 304 is moved in circumferential direction, hence moving the carrier body 7. The movement is opposite that of the carrier body 6, however with the same gearing transfer ratio, so that the movement will be identical, but in opposite direction. Simultaneous and symmetrical shift of the carrier bodies 6, 7, with respect to a reference line or plane, shown schematically as line CL, will be the result.

Figure 5:
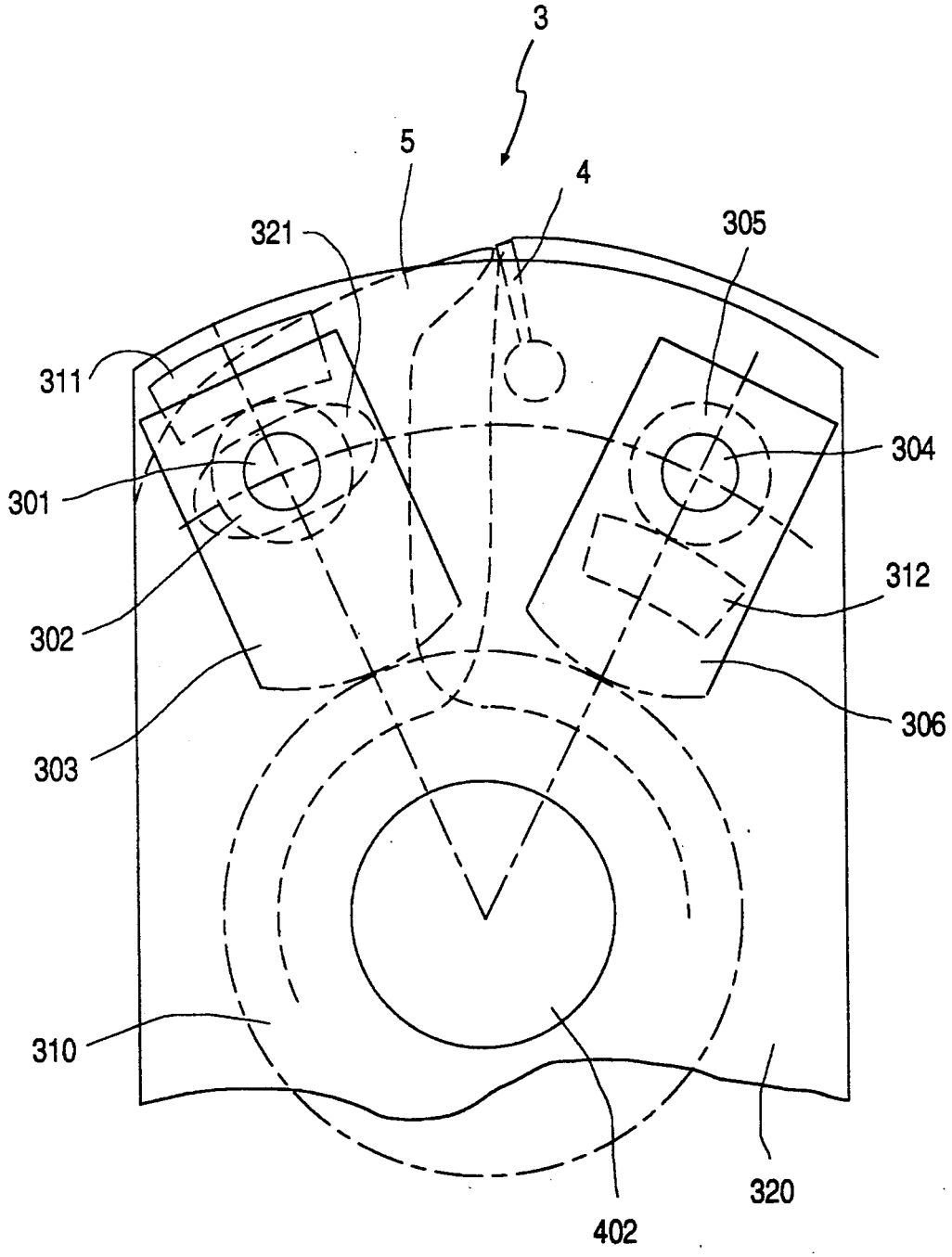
FIG. 5 is a fragmentary highly simplified axial end view illustrating the arrangement of the rotation reversal system of FIG. 4.

FIG. 5 is a highly schematic axial end view, omitting all elements not necessary for an understanding of the operation, of the essential components of the embodiment of FIG. 4. The rotation reversal drive 314 is specifically shown. The gear elements 303 and 306, in engagement with the gear 310, as well as the gears 302 and 305, in engagement with the gear elements 311 and 312 are visible. It is clearly seen that rotary movement of the gear 310 is transferred in equal, but oppositely directed rotation of the gears 302 and 305 due to the roll-off of the gear elements 303 and 306, respectively. This is obtained by rolling off the gears of one gear element which is an internal gearing and the other which is an external gearing, so that respectively oppositely directed rotational, rocking or swiveling movement of the carrier bodies 6 and 7 will result.

A hand wheel 29 can be used to axially shift the spindle 325, as illustrated in connection with the embodiment of FIG. 2; alternatively, a motor drive, as illustrated in connection with the embodiment of FIG. 1, may be used. Any other axial shifting position of the spindle 325 can be employed.

The gearing of gear 308 and the engaged pinion 331 may, for example, be a straight, axially extending gearing, whereas the gearing on the pinion 332 in engagement with the gear 309 is an inclined, or spiral gearing, so that axial shift of the gear 332 will cause relative rotation of the gear 309 with respect to the gear 308. Alternatively, gears 308 and 331, likewise, may have inclined or spiral gearing, in which the angle of inclination is opposite that of the gear combination 309-332.

The system in accordance with the present invention has numerous advantages. The adjustment movement is entirely by gears, and there is no self-holding or frictional element which is directly concerned with the adjustment movement; the spindle 325 can be arranged to rotate freely, with a suitable lock or jaw clamp. The arrangement need be provided only once on a folding jaw cylinder, to control the position of all the folding jaw pairs. Thus, only a single gearing, formed as a combination of the gear block 13, 112, 313, and only a single rotation reversal drive, as shown for example at 14, 114; 109, 110, 121, 122; and 314 need be provided, controlling the position of all the carrier bodies 6, 7. The various elements, and especially the gearing and the adjustment gearing, continuously rotate, so that concentration of loading on specific spots or locations, which may correspond to a frequently used jaw setting, is avoided. The adjustment arrangement can be constructed independently of the number of folding jaw pairs 3, and need be assembled within a folding jaw cylinder only once, even if the folding jaw cylinder is later modified, so that assembly and adjustment need be carried out only once. The folding jaw cylinder can be used also in connection with bundled, stacked or assembled products to be folded, which need not necessarily follow each other sequentially, so that even in a collection folding, uneven loading, and thus uneven wear of the gears, is eliminated. If a separate gear were to be used for each folding jaw pair 3, uneven wear of the respective gear arrangements might result.

It is readily possible to provide gears with suitable pitch and gear tooth configuration so that the gearing can be easily assembled and adjusted once for operation essentially without play and, by use of well known gear adjustment arrangements, the gearing can be easily readjusted in case of wear. All elements used, and the gears and gear elements themselves, can be standard articles of manufacture, so that the overall cost of construction of the system is a minimum. Carriers 6, 7 of multiple jaw pairs can be linked together.

Various changes and modifications may be made, and any features described herein may be used with any of the others, within the scope of the inventive concept.

We claim:

1. An adjustment system for concurrent, symmetrical adjustment of the mutual position of first and second folding jaws (4, 5) of a folding jaw pair (3) of a folding jaw cylinder (1, 201, 401), said cylinder having a cylinder shaft (2, 202, 402);

a first folding jaw carrier body (6) supporting said first folding jaw (4) thereon;

a second folding jaw carrier body (7) supporting said second folding jaw (5) thereon;

position adjustment means (13, 14, 114; 112; 314) located on said cylinder shaft and coupled to said jaw carrier bodies (6, 7) of the jaw pairs (3) for effecting a pincer or scissor-like movement of said folding jaw carrier bodies and hence of said folding jaws towards or away from each other essentially symmetrically about a central or pinching line (CL);

axially movable position control means (25, 125, 325) coupled to said position adjustment means, and wherein the position adjustment means (13, 14, 114; 112; 314) comprise, in accordance with the invention, gear means (13, 112; 313) coupled to said position control means (25, 125, 325) and rotatable therewith, said gear means including a gearing means rotatable about and relative to said shaft (2) and coupled to one of said jaw carrier bodies for rocking or swiveling said one of the jaw carrier bodies about the shaft in a first direction;

and a rotation reversal arrangement rotatably connected to said gearing means and to the other jaw carrier body, said position adjustment means being coupled to said gearing means for conjointly rocking or swiveling said jaw carrier bodies (6,7) in opposite directions upon rotation of said gearing means under control of the position control means (25, 125, 325).

2. The system of claim 1, wherein said position control means includes a spindle and a hand wheel (29) coupled to the spindle for rotating the spindle.

3. The system of claim 1, wherein said position control means includes a spindle and a motor drive (30) for rotating said spindle.

4. The system of claim 1, wherein said position control means includes a threaded spindle (25) and a spindle nut means (23) restrained from rotation, to move the spindle nut means axially upon rotation of the threaded spindle.

5. The system of claim 1, wherein said carrier bodies (6, 7) are pivotably or rockingly or swivelingly supported on the cylinder (1, 201, 401) for rocking or swiveling or pivoting movement with respect to the shaft (2, 202, 402) of the cylinder;

said rotation reversal arrangement comprises a rotation reversal gearing (14, 314) coupling said jaw carrier bodies;

and wherein said gear means further includes a gear block (3, 313) having at least two gears (31, 32, 331, 332) with external gear teeth, the position control means (25, 125, 325) being coupled to said gear block (13, 313) for axial movement thereof;

said gearing means includes a first gear (8, 308) secured and rotatable with said shaft (2, 402), said first gear being in engagement with one of the gears (31, 331) of the gear block; and a second gear (9, 309) coaxial with respect to said shaft (2, 402) rotating therewith and, additionally, rotatable with respect thereto, and coupled to one (6) of said carrier bodies, said second gear (9, 309) being coupled to the second gear (32, 332) of the gear block, rotation to the other (7) of said carrier bodies being transferred thereto, in opposite direction, by said rotation reversal gearing (14, 314).

6. The system of claim 5, wherein (FIG. 1) the second gear (9) is securely coupled to said one folding jaw carrier body (6).

7. The system of claim 6, further including a hollow cylindrical sleeve element (15) surrounding said cylinder shaft (2), said second gear (9) being secured to said hollow cylindrical sleeve element, and said one folding jaw carrier body (6) being additionally secured to said hollow cylindrical sleeve element at an axial position remote from said second gear (9);

said hollow cylindrical sleeve element being rotatable or rockable with respect to said shaft (2).

8. The system of claim 5, further including a gear train (315, 310, 303, 301) connecting the second gear (309) with said one (6) folding jaw carrier body.

9. The system of claim 5, wherein the gear block (13, 313) comprises a block body (24, 324) having an internal thread (23, 323) thereon;

said position control means (25, 325) comprises a threaded spindle threaded into said thread of the block, said block being axially movable and constrained with respect to rotation;

and at least two gear elements (31, 32; 331, 332), located on said positioning carrier block (24, 324).

10. The system of claim 5, wherein the first gear (8, 308) and the first gear element (31, 331) have spiral or axially inclined gear teeth thereon;

said second gear (9, 309) and said second gear element (32, 332) have spirally axially inclined gears thereon, in which the angle of inclination is opposite that of the angle of inclination of the inclined teeth of the first gear and the first gear element, whereby, upon axial shifting of the gear block retaining said gear elements, the second gear will rotate relative to said first gear.

11. The system of claim 5, wherein the first gear (8, 308) and the first gear element (31, 331) in engagement with said first gear have axially directed straight gear teeth; and wherein the second gear (9, 309) and the second gear element (32, 332) have inclined or spiral gear teeth whereby, upon axial shifting of the gear block retaining said gear elements, the second gear will rotate relative to said first gear.

12. The system of claim 1, wherein (FIG. 2) said gear means (112) comprises a holder (126) coupled to said position control means (125) for axially controlling the position of said gear means (112) in a direction parallel to the axis of rotation of said shaft (2);

a pinion shaft (119) retained in said holder (126);

a first pinion (120), a second pinion (121) and a third pinion (122) secured to the pinion shaft (119);

a fourth gear (108) secured to said cylinder shaft (202) and in meshing engagement with the first pinion (120);

a fifth gear (109) coupled to one (7) of the folding jaw carrier bodies (6, 7), said fifth gear being in meshing engagement with the second pinion (121); and a sixth gear (110) coupled to the other folding jaw carrier body (6) and in meshing engagement with the third pinion (122), said second pinion (120) and said fourth gear (108) forming one part of said gearing means, and said third pinion (122) and said fifth gear (109) forming another part of said gearing means, said gearing means having gear teeth arranged to provide for simultaneous scissor or pincer-like shifting of the jaw carrier bodies with respect to each other upon axial repositioning of the position control means and hence of the holder (126).

13. The system of claim 12, wherein the first pinion (122) carries axially directed gear teeth;

the second and third pinion (121, 122) carry inclined or spiral gears with oppositely directed angles of inclination;

the fourth gear (108) carries axially directed gear teeth; and wherein the fifth and sixth gears (109, 110) carry inclined or spiral gears of opposite angles of inclination, and arranged for engagement with the respective pinions (121, 122).

14. The system of claim 8, further including a second flanged sleeve (16) surrounding the cylinder shaft (2) and rotatable with respect thereto;

said first one of the folding jaw carrier bodies (7) and the fifth gear (109) being secured to said flanged bushing for rotation therewith;

a third flanged bushing (17) surrounding the second flanged bushing (16) and being rotatable with respect thereto, the other (6) folding jaw carrier body, and the sixth gear (110) being securely connected and coupled to said third flanged bushing (17).

15. The system of claim 1, wherein said rotation reversal arrangement comprises a gearing (10, 14, 11; 110, 122, 121, 109; 301–310) coupled respectively to both said jaw carrier bodies (6, 7).

16. The system of claim 5, wherein said rotation reversal arrangement comprises a gearing (10, 14, 11; 110, 122, 121, 109; 301–310) coupled respectively to both said jaw carrier bodies (6, 7);

and wherein said gearing means is directly coupled to one (6) of said carrier bodies, and said gearing means and the rotation reversal arrangement are combined into one gear train.

17. The system of claim 1, wherein at least one of said gearing means includes an inclined, spiral gear coupled to said position control means (125) whereby, upon axial movement of said position control means, the relative rotary position of said at least one gearing means will change with respect to another gearing means.

18. The system of claim 1, wherein said gearing means includes two inclined or spiral gears in which the angles of inclination of the gear teeth of the gearing means are opposite to each other, and wherein at least one gear of said gearing means is coupled to the position control means (25, 125, 325) whereby, upon axial shifting of the position control means, the gears will twist about the shaft (2, 202, 402), and thereby rock or swivel the jaw carrier bodies respectively coupled to the gearing means.

* * * * *